US010506851B2

(12) United States Patent
McCabe et al.

(10) Patent No.: US 10,506,851 B2
(45) Date of Patent: Dec. 17, 2019

(54) SYSTEM AND APPARATUS FOR INSTALLING A ZIPPER CLOSURE

(71) Applicants: Clay McCabe, Portland, OR (US); Gregory Huffman, Portland, OR (US)

(72) Inventors: Clay McCabe, Portland, OR (US); Gregory Huffman, Portland, OR (US)

( * ) Notice: Subject to any disclaimer, the term of this patent is extended or adjusted under 35 U.S.C. 154(b) by 142 days.

(21) Appl. No.: 15/421,902

(22) Filed: Feb. 1, 2017

(65) Prior Publication Data

US 2017/0231331 A1 Aug. 17, 2017

Related U.S. Application Data

(60) Provisional application No. 62/289,750, filed on Feb. 1, 2016.

(51) Int. Cl.
*A44B 19/24* (2006.01)
*A44B 19/02* (2006.01)

(52) U.S. Cl.
CPC ..... *A44B 19/24* (2013.01)

(58) Field of Classification Search
CPC ..... A44B 19/24; A44B 19/34; Y10T 24/25
See application file for complete search history.

(56) References Cited

U.S. PATENT DOCUMENTS 2,971,200 A * 2/1961 Lindsey ..... A41H 37/003 2/128
3,456,305 A * 7/1969 Voit ..... A44B 19/34 112/475.16
3,685,103 A * 8/1972 Severino ..... A41H 37/003 24/304
4,137,859 A * 2/1979 Itoh ..... A41H 37/003 112/475.09
6,493,909 B2 * 12/2002 Paul ..... A41F 1/00 24/381
2013/0061434 A1 * 3/2013 Hampton ..... A44B 19/02 24/415
2015/0216267 A1 * 8/2015 Burkhart-Day ..... A44B 19/24 24/381

* cited by examiner

*Primary Examiner* — Robert Sandy
*Assistant Examiner* — Rowland Do
(74) *Attorney, Agent, or Firm* — Mohr Intellectual Property Law Solutions, PC

(57) ABSTRACT

Zippers, including a device for replacing a malfunctioning zipper. In some examples, the zipper includes a plurality of attaching means that fit over the teeth of a malfunctioning zipper. In some further examples, the zipper may function to repair a tear in the material of an item.

18 Claims, 10 Drawing Sheets

SYSTEM AND APPARATUS FOR INSTALLING A ZIPPER CLOSURE

CROSS REFERENCE TO RELATED APPLICATIONS

This application claims priority to U.S. Application Ser. No. 62/289,750, filed on Feb. 1, 2016, which is hereby incorporated by reference for all purposes.

BACKGROUND

The present disclosure relates generally to fabric and fabric repair. In particular, systems and devices for installing or adding zipper closures are described.

Zippers are common devices that are used to bring together the edges of an opening of flexible material. They are routinely employed as closing mechanisms for garments, luggage, sporting goods, camping gear, and other items. Typical zipper closures consist of two rows of interdigitating teeth and a slider, operated by hand, that moves along the rows of teeth. Inside the slider is a Y-shaped channel that meshes together or separates the opposing rows of teeth, depending on the direction of the slider's movement.

Known zippers are not entirely satisfactory for the range of applications in which they are employed. For example, modern zippers frequently malfunction or break which render the intended closure inoperable. Sometimes one of the teeth may be damaged or broken off, which results in the zipper becoming unworkable. In addition, conventional zippers are not easily repaired in the event of, for example, damaged or missing teeth and/or insertion pins or a broken retainer box. When this happens, there is no way to immediately repair the zipper, which can lead to embarrassing, or even dangerous circumstances. In other circumstances, a person might want to add a zipper to an item without the necessity of sewing skills or employing a tailor. Other times, when a zipper breaks, there is no other choice to discard the entire garment or item in which it is employed.

Thus, there exists a need for zippers that improve upon and advance the design of known zippers. Such zippers should function alone or to replace a broken zipper. They should be portable, durable, lightweight, easy to use, and cheap to manufacture. Examples of new and useful zippers relevant to the needs existing in the field are discussed below.

SUMMARY

The present disclosure is directed to a device for replacing a malfunctioning zipper. In some examples, the zipper includes a plurality of attaching means that fit over the teeth of a malfunctioning zipper. In some further examples, the zipper may function to repair a tear in the material of an item.

DETAILED DESCRIPTION

The disclosed zippers will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various zippers are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The present invention functions to add a zipper to a piece of fabric in order to replace a broken zipper or to add a zipper where there previously wasn't one. The improved zipper comprises a pair of flexible strips that comprise complimentary teeth similar to a standard zipper. The system also comprises a number of attachment mechanisms that function to attach the strips to, for example, a broken zipper or a torn piece of fabric.

With reference to FIGS. 1-11 a first example of a device for repairing, replacing, or creating a zipper closure, zipper 100, will now be described. Zipper 100 functions to attach to a broken zipper or, in the alternative, attach to a tear in a piece of fabric. The reader will appreciate from the figures and description below that zipper 100 addresses shortcomings of conventional zippers.

For example, zipper 100 overcomes the problem of discarding a garment or hiring a tailor to fix a broken zipper because it is designed to work with an item's existing features. Further, zipper 100 may be removed and reused with different items depending on the user's needs. In alternative embodiments (not shown), the zipper includes additional or alternative features, such as an application tool.

Figure 1:
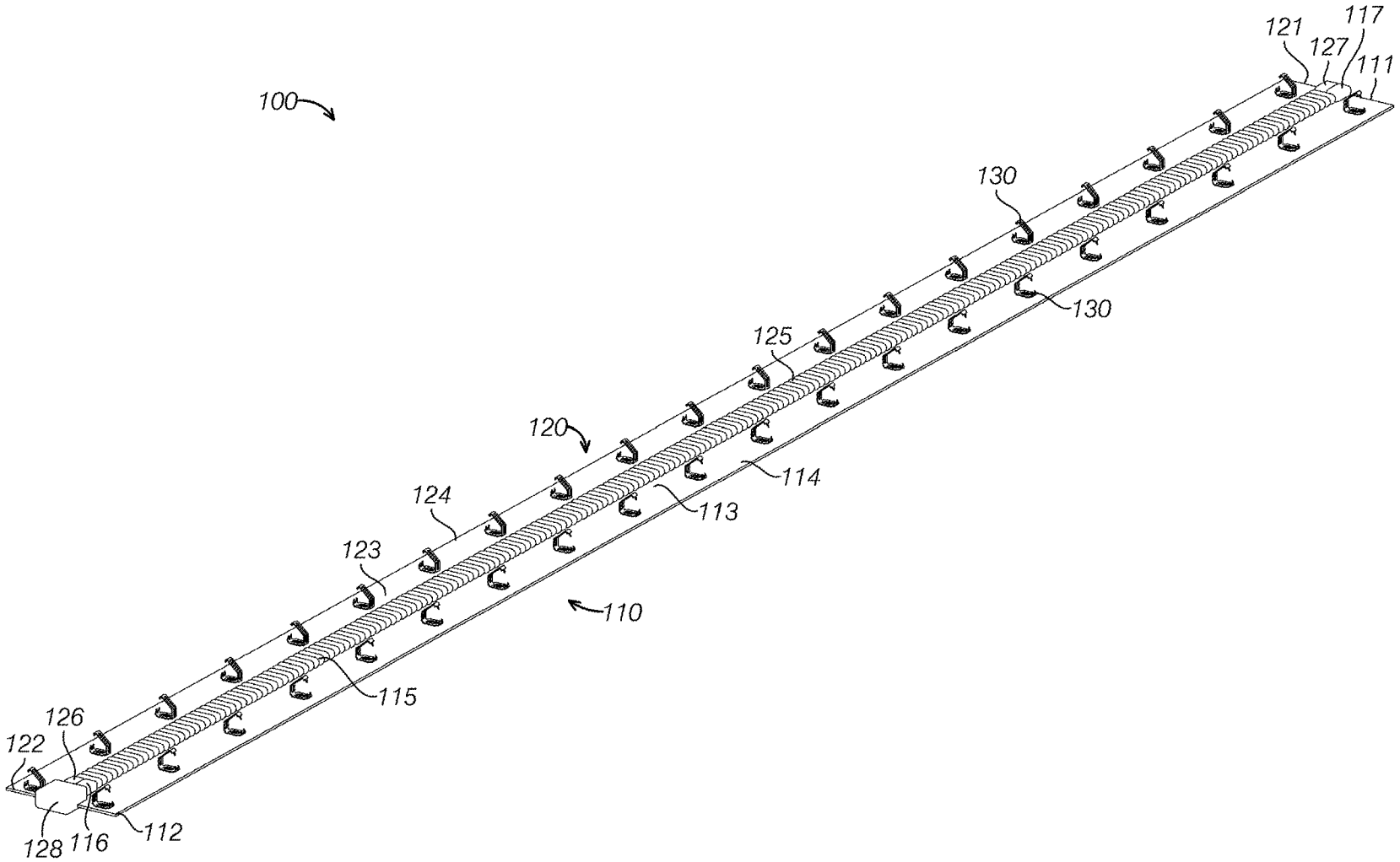
FIG. 1 is a perspective view of a first example of a zipper according to an embodiment of the present invention.

FIG. 1 is an illustration of zipper 100 that depicts a right tape 110, a left tape 120, and a plurality of attaching means 130. Right tape 110 further comprises a right tape top 111, a right tape bottom 112, a right tape proximal side 113, a right tape distal side 114, a plurality of right tape teeth 115, a right tape pin 116, and a right tape top stop 117. As can be seen, the plurality of right tape teeth 117 extends laterally along the length of right tape 110 and terminates in right ape top stop 117 within the right tape top 111. The reader will appreciate that the plurality of right ape teeth 115 also extends laterally toward right tape bottom 112 and terminates in right tape pin 116

Similarly, left tape 120 further comprises a left tape top 121, a left tape bottom 122, a left tape proximal side 123, a left tape distal side 124, a plurality of left tape teeth 125, a left tape pin 126, and a left tape top stop 127. As can be seen, the plurality of left tape teeth 125 extends laterally along the length of left tape 120 and terminates in left ape top stop 127 within the left tape top 121. The reader will appreciate that the plurality of left ape teeth 125 also extends laterally toward left tape bottom 122 and terminates in left tape pin 126

As can be seen, the plurality of attaching means 130 is affixed near the distal sides (114, 124) and extending laterally along left tape 120 and right tape 110. Further, the present and subsequent figures depict left tape 120 and right tape 110 connected to one another. However, it should be understood that left tape 120 and right tape 110 may attach to, and detach from, one another when zipper 100 is in use. When left tape 120 and right tape 110 are connected, the plurality of left tape teeth 125 and the plurality of right tape teeth 115 are meshed together with left tape pin 126 and right tape pin 116 inserted into, and secured within, retainer box 128 as shown.

It should be understood that, in the present embodiment, left tape 120 and right tape 110 comprise a sturdy flexible material such as canvas. In alternative embodiments (not shown) left tape 120 and/or right tape 110 may comprise different materials appropriate for, and relevant to, the item zipper 100 is being utilized in connection with. In some examples left tape 120 and/or right tape 110 may comprise natural or synthetic fibers, polymers or copolymers, or other suitable materials according to the user's specifications without departing from the scope of the invention.

Figure 2:
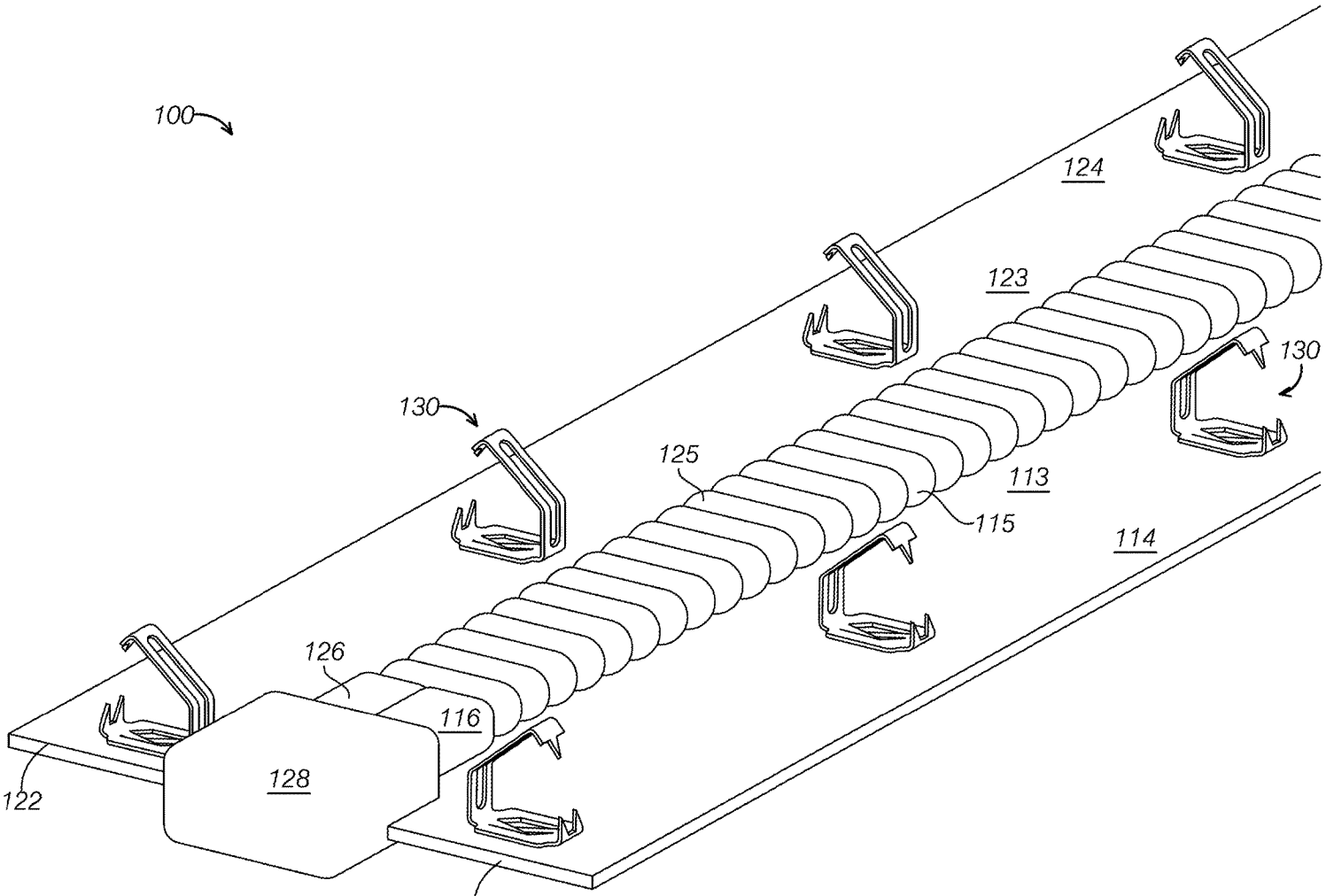
FIG. 2 is a magnified view of the bottom portion of a zipper according to an embodiment of the invention.

In the example shown in FIG. 2, a close up of a portion of zipper 100 is shown. The present figure depicts left tape 120 and right tape 110 connected together with the plurality of left tape teeth 125 and the plurality of right tape teeth 115 meshed. It should be understood that, in this configuration of use, the plurality of teeth (115, 125) alternate in the same manner as traditional zipper closures known in the art. As can be seen, the plurality of attaching means 130 are affixed in equal numbers along the length of left tape 120 and right tape as shown. In the example shown in figure one, there are 40 attaching means 130 (20 attaching means 130 on left tape 120 and 20 attaching means 130 on right tape 110). Further, FIGS. 1 and 2 depict attaching means 130 affixed to left tape 120 and right tape 110 in opposing pairs, however it is an object of the present invention that other configurations and numbers of attaching means 130 may be employed. Thus, in alternative embodiments (not shown) plurality of attaching means 130 may comprise a different number and arrangement according to the user's needs, the length of the first zipper 160 (discussed in further detail below), and the unique configuration of the item zipper 100 is being utilized to repair. By way of example only, FIG. 2 depicts each of the plurality of attaching means 130 in an open position (discussed in further detail below).

Figure 3:
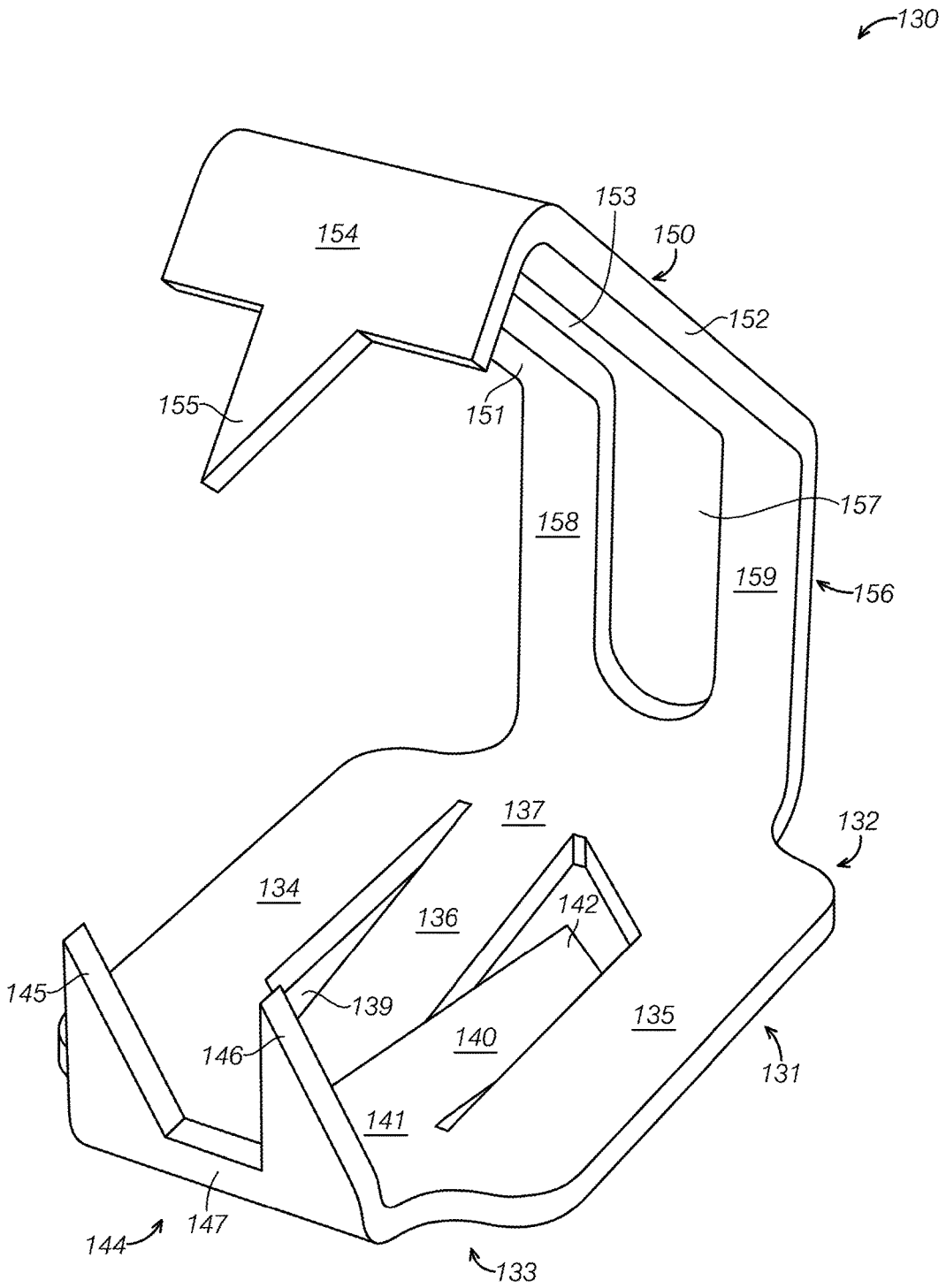
FIG. 3 is a perspective view of an attaching means in an open position for a zipper according to an embodiment of the present invention.
Figure 4:
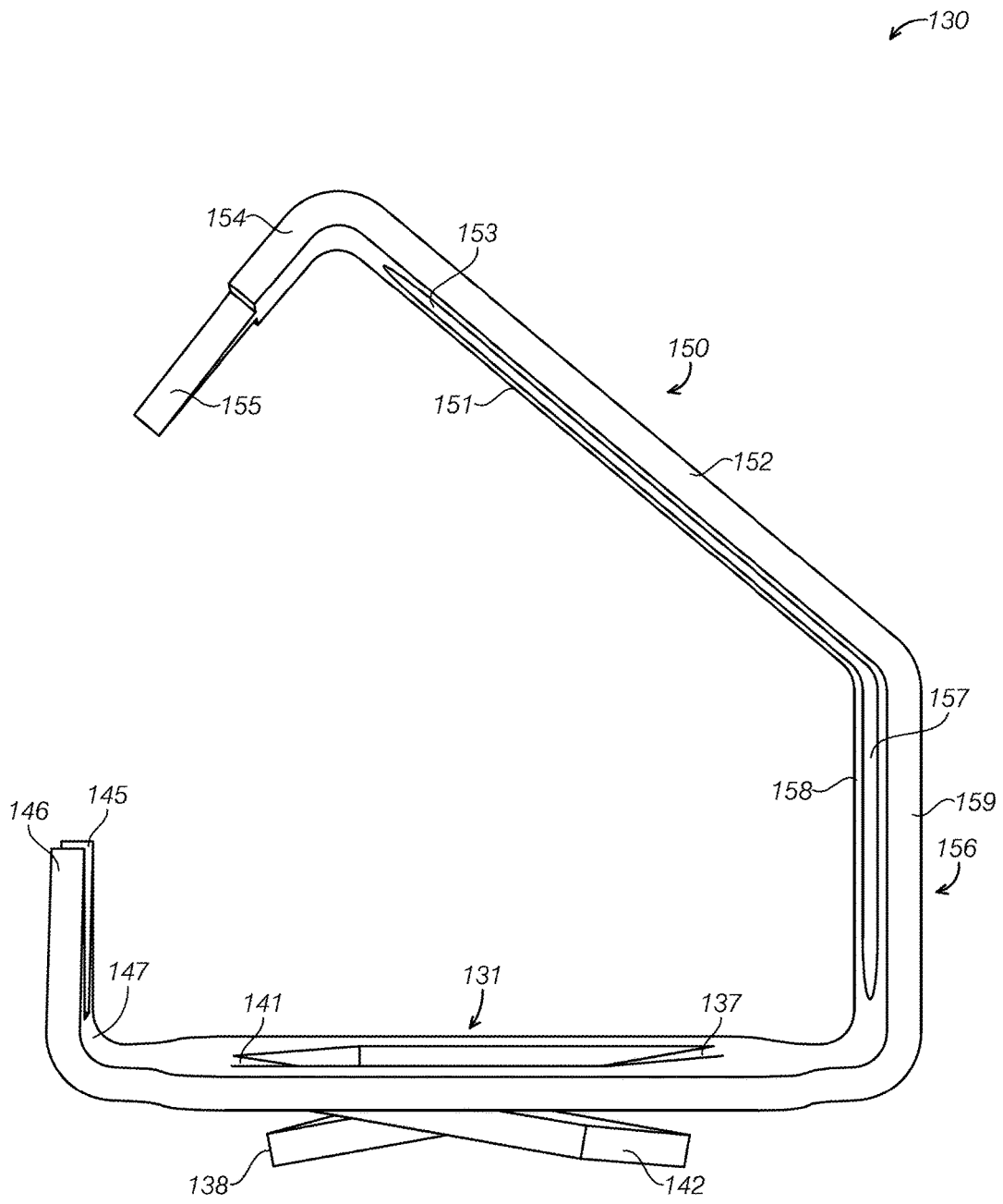
FIG. 4 is an orthogonal side view of an attaching means in an open position for a zipper according to an embodiment of the present invention.
Figure 5:
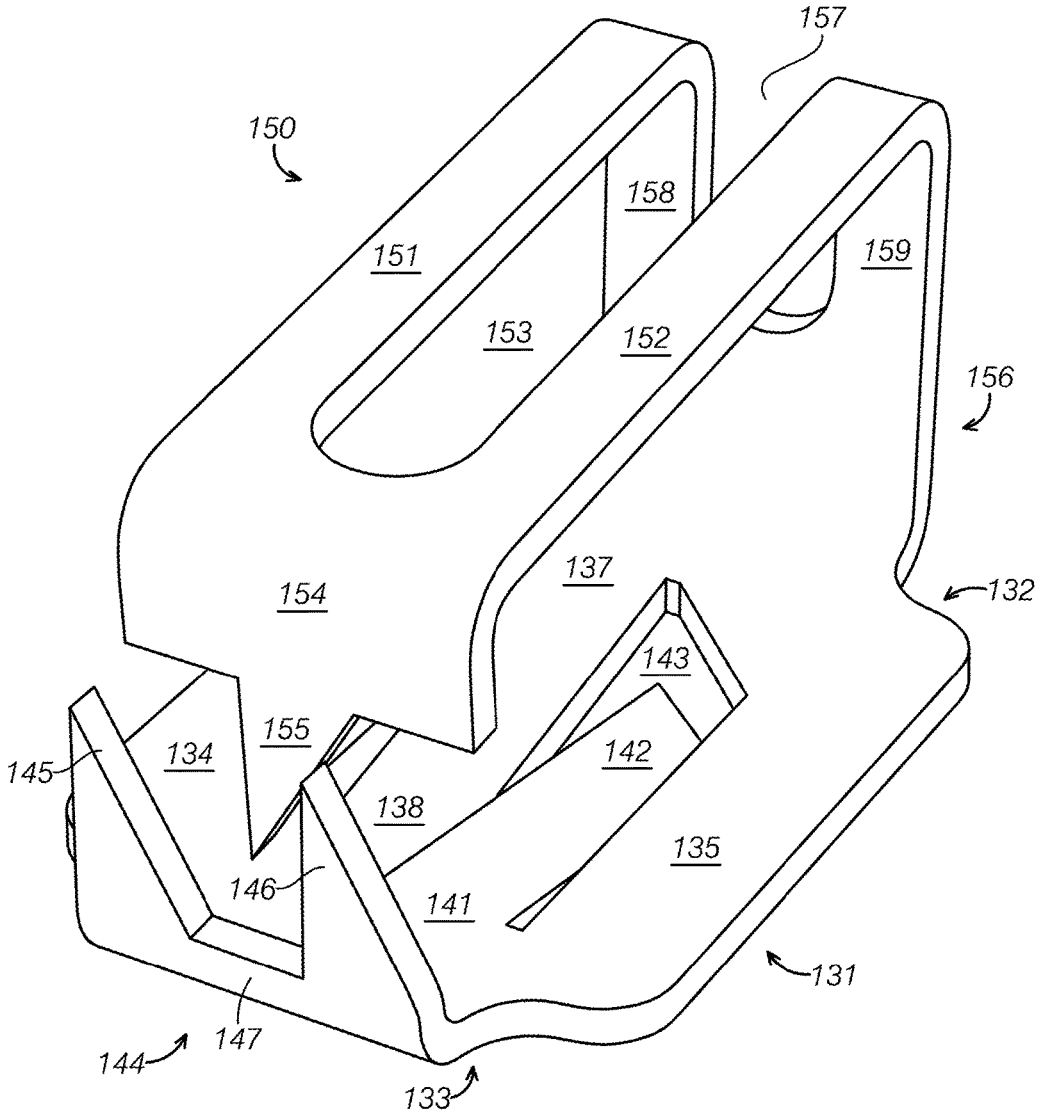
FIG. 5 illustrates a perspective view of an attaching means in a closed position for a zipper according to an embodiment of the present invention.
Figure 6:
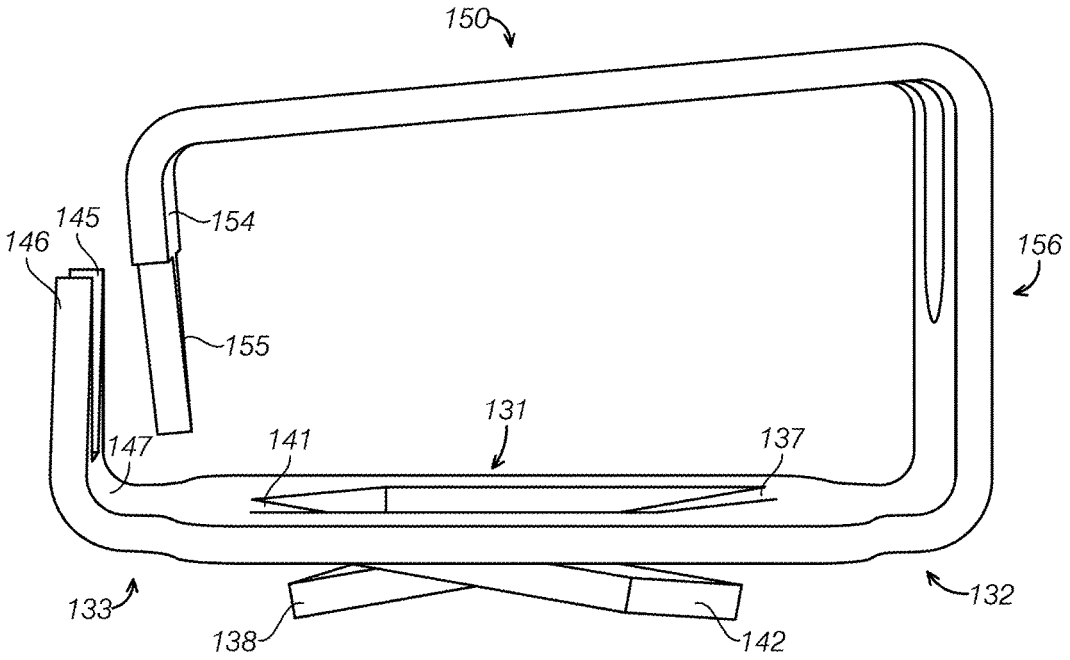
FIG. 6 illustrates an orthogonal side view of an attaching means in a closed position for a zipper according to an embodiment of the present invention.

Referring now to FIGS. 3, 4, 5, and 6, different views of attaching means is shown and described. FIG. 3 illustrates a perspective view of attaching means 130 in an open position while FIG. 4 illustrates an orthogonal side view of attaching means 130 in an open position. FIG. 5 illustrates a perspective view of attaching means 130 in a closed position while FIG. 6 illustrates an orthogonal side view of attaching means 130 in a closed position.

In a preferred embodiment, attaching means 130 comprises an attaching means base 131, an attaching means top 150, and an attaching means back 156. Attaching means base 131 further comprises an attaching means base proximal side 132, an attaching means base distal side 133, an attaching means base first plate 134, and an attaching means base second plate 135. Attaching means base 131 also comprises an attaching means first tack 136 and an attaching means second tack 140.

As can be seen, attaching means first tack 136 and attaching means second tack 140 are tab-like structures, each having a stationary end (137, 141) and a securing end (138, 142) extending through first tack aperture 139 and second tack aperture 143. Thus, the stationary portion of first tack 136 is substantially within attaching means distal side 133 and adjacent to attaching means first plate 134 with the securing end extending down through first tack aperture 139 substantially within attaching means proximal side 132 as shown. Similarly, the stationary portion of second tack 140 is substantially within attaching means proximate side 132 and adjacent to attaching means second plate 135 with the securing end extending down through second tack aperture 143 substantially within attaching means distal side 133 as shown.

The reader will appreciate that the securing ends and the stationary ends of the tacks are positioned opposite one another. In this manner, the tacks function to secure attaching means 130 to left tape 119 and/or right tape 110. In alternative embodiments (not shown) attaching means may be affixed to left tape 120 and/or right tape 110 via adhesives, pins, brads, or other suitable means. In further alternative embodiments (also not shown), attaching means base 131 may secure attaching means 130 to an opening in the material of another item, thus functioning as a standalone zipper.

As mentioned above, attaching means 130 comprises attaching means top 150 and attaching means back 156. Attaching means top 150 comprises an attaching means top first plate 151, an attaching means top second plate 152, an attaching means top aperture 153, an attaching means pin support 154, and an attaching means pin 155. Attaching means 130 further comprises an attaching means back 156 having an attaching means back aperture 157, an attaching means back first plate 158 and an attaching means back second plate 159. As can be seen, attaching means back 156 is located within attaching means distal side 133 whereby attaching means back first plate 158 is substantially congruent with attaching means base first plate 134, and attaching means top first plate 151, and whereby attaching means back second plate 159 is substantially congruent to attaching means base second plate 135 and attaching means top second plate 152 as shown.

Finally, attaching means base 131 also comprises an attaching means fork 144 having an attaching means fork support 147 that serves to retain attaching means fork first tine 145 and attaching means fork second tine 146. The dimensions of the opening created by attaching means fork first tine 145 and attaching means fork second tine 146 are complimentary to attaching means pin 155 such that they comprise a substantially male-female coupling arrangement whereby the fork is the female coupler and the pin is the male coupler as shown. As can be seen, attaching means fork 144 is positioned at attaching means base proximal side 132 and is substantially perpendicular to attaching means base 131, whereby attaching means fork second tine 146 is adjacent to second tack stationary end 141 and attaching means fork first tine 145 is adjacent to first tack securing end 138.

As also mentioned above attaching means comprises an open position (as illustrated by FIGS. 3 and 4) and a closed position (as illustrated by FIGS. 5 and 6). As illustrated by FIGS. 3 and 4, when in the open position, attaching means top 150 is at an acute angle with respect to attaching means back 156 and attaching means base 131 with attaching means pin 155 is separated from attaching means fork 144 as shown. As illustrated by FIGS. 5 and 6, when attaching means 130 is in the closed position, attaching means top 150 is at a substantially 90 degree angle with respect to attaching means back 156 and substantially parallel to attaching means base 131, with attaching means pin 155 located between attaching means fork first tine 145 and attaching means fork second tine 146. In this manner, attaching means fork 144, attaching means pin 155, attaching means base 131, and attaching means top 150 form a quadrilateral enclosure (discussed in further detail below) when attaching means 130 is in the closed position.

In the present embodiment, attaching means 130 comprises a pliant metal such as aluminum. It is an object of the present invention that other sturdy pliant materials may be employed without departing from the scope of the invention, such as metals and metal alloys, polymers, and the like. Further, it should be understood that it is an object of the present invention that the dimensions of attaching means are complimentary to the dimensions of, and designed to enclose, the teeth in a standard zipper (discussed in further detail below). In alternative embodiments (not shown) a specialized tool may be employed to place attaching means 130 in the closed position.

Figure 7:
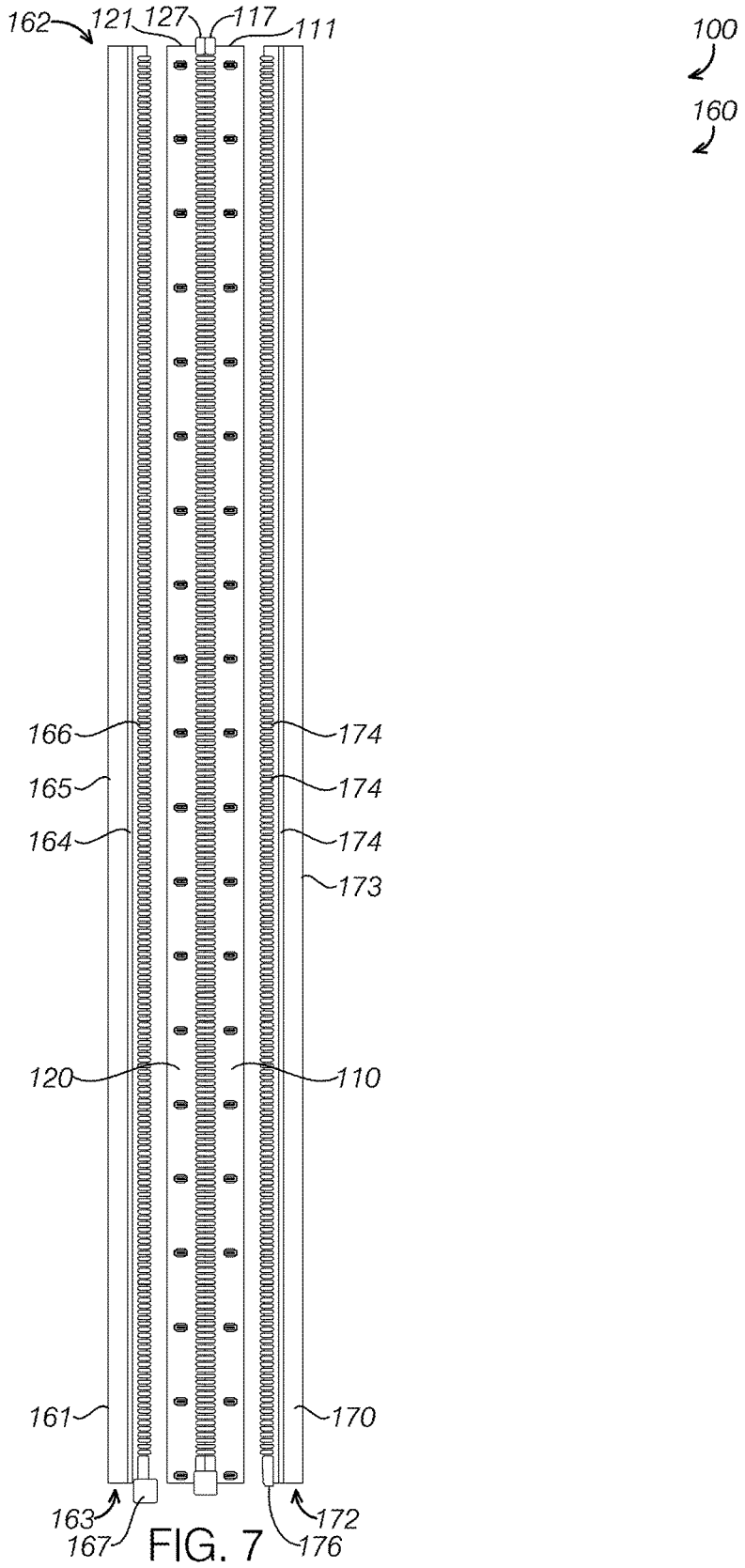
FIG. 7 illustrates a plan view of a zipper repair system according to an embodiment of the present invention.

Turning attention to FIG. 7 and which illustrate zipper 100 positioned to repair a first zipper 160. As mentioned above, zipper 100 may function as a standalone zipper, thus, while the present figures illustrate zipper 100 being used to repair an existing zipper, first zipper 160, the reader will appreciate this is by way of example only. It should be understood that when the user wishes to use zipper 100 as a standalone zipper, she will employ and attach it in the same way as described below. In that manner, the user will attach right tape 110 to a congruent portion of material in an item (as opposed to a first zipper right tape) and attach left tape 120 to an adjacent congruent portion of material in the same item (as opposed to a first zipper left tape).

In the present embodiment, the zipper that is to work in concert with zipper 100, first zipper 160, comprises a standard zipper comprising components known in the art. Thus, first zipper 160 comprises a first zipper left tape 161 having a first zipper left tape top 162, a first zipper left tape bottom 163, a first zipper right tape proximal side 164, a first zipper left tape distal side 165, a plurality of first zipper left tape teeth and a first zipper retainer box 167. Similarly, first zipper 160 comprises a first zipper right tape 170 having a first zipper right tape top 171, a first zipper right tape bottom 172, a first zipper right tape proximal side 173, a first zipper right tape distal side 174, a plurality of first zipper right tape teeth 175, and a first zipper right tape pin. First zipper 160 also comprises a pull (not shown).

Figure 8:
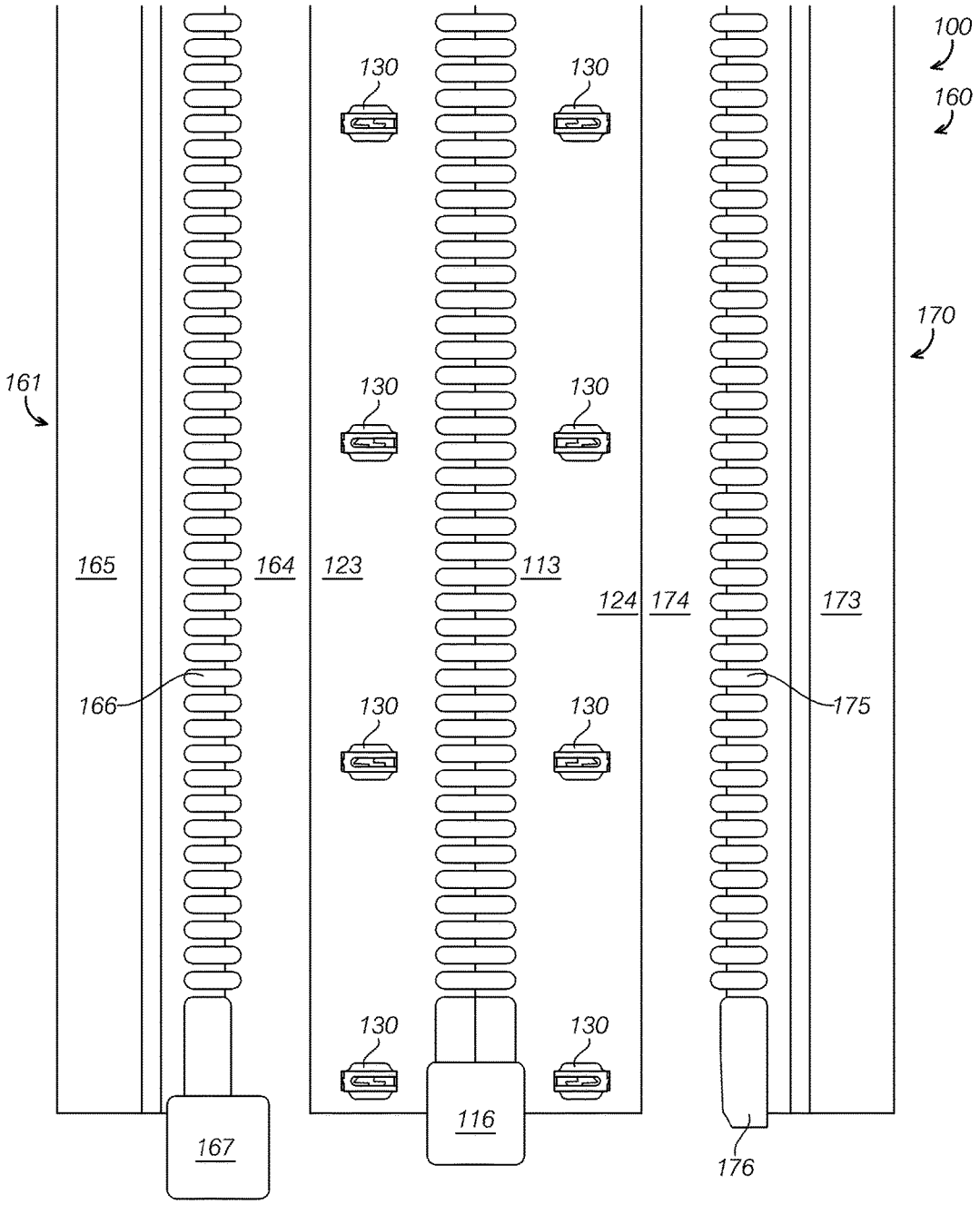
FIG. 8 is a magnified view of the bottom portion of a zipper repair system according to an embodiment of the invention.

When the user wishes to employ zipper 100 according to the embodiment in FIGS. 7 and 8, then she will align zipper 100 such that right tape 110 is adjacent to a first zipper right tape 170 and left tape 120 is adjacent to first zipper left tape 161. Thus, as depicted in FIG. 7, the components of zipper 100 and first zipper 160 are congruent. In this manner, first zipper left tape top 162 is adjacent to zipper left tape top 121, first zipper right tape top 171 is adjacent to zipper right tape top 111. In this manner, the plurality of right tape teeth 115 is adjacent to the plurality if first zipper right tape teeth 175 while the plurality of left tape teeth 125 is adjacent to the plurality if first zipper left tape teeth 166.

As illustrated by FIG. 8, the reader will appreciate that, once zipper 100 is aligned with first zipper 160, each the plurality of attaching means 130 attached to one of the said plurality of first zipper teeth 166, while first zipper right tape pin 176 is adjacent to right tape pin 116 and the right side of retainer box 128 while first zipper retainer box 167 is adjacent to the left side of retainer box 116 as shown.

Figure 9:
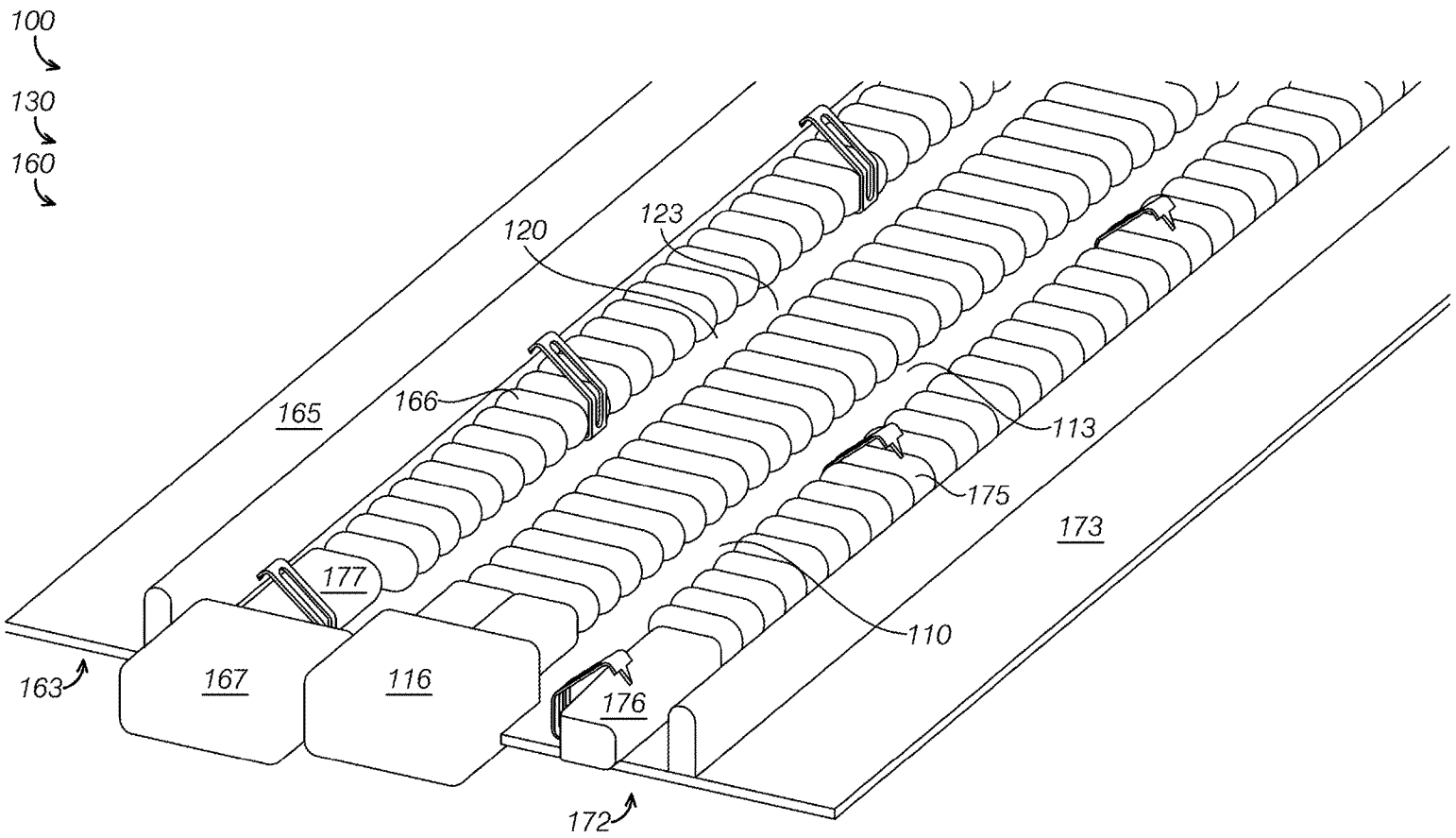
FIG. 9 is a perspective view of a zipper repair system having attaching means in an open position according to an embodiment of the invention.
Figure 10:
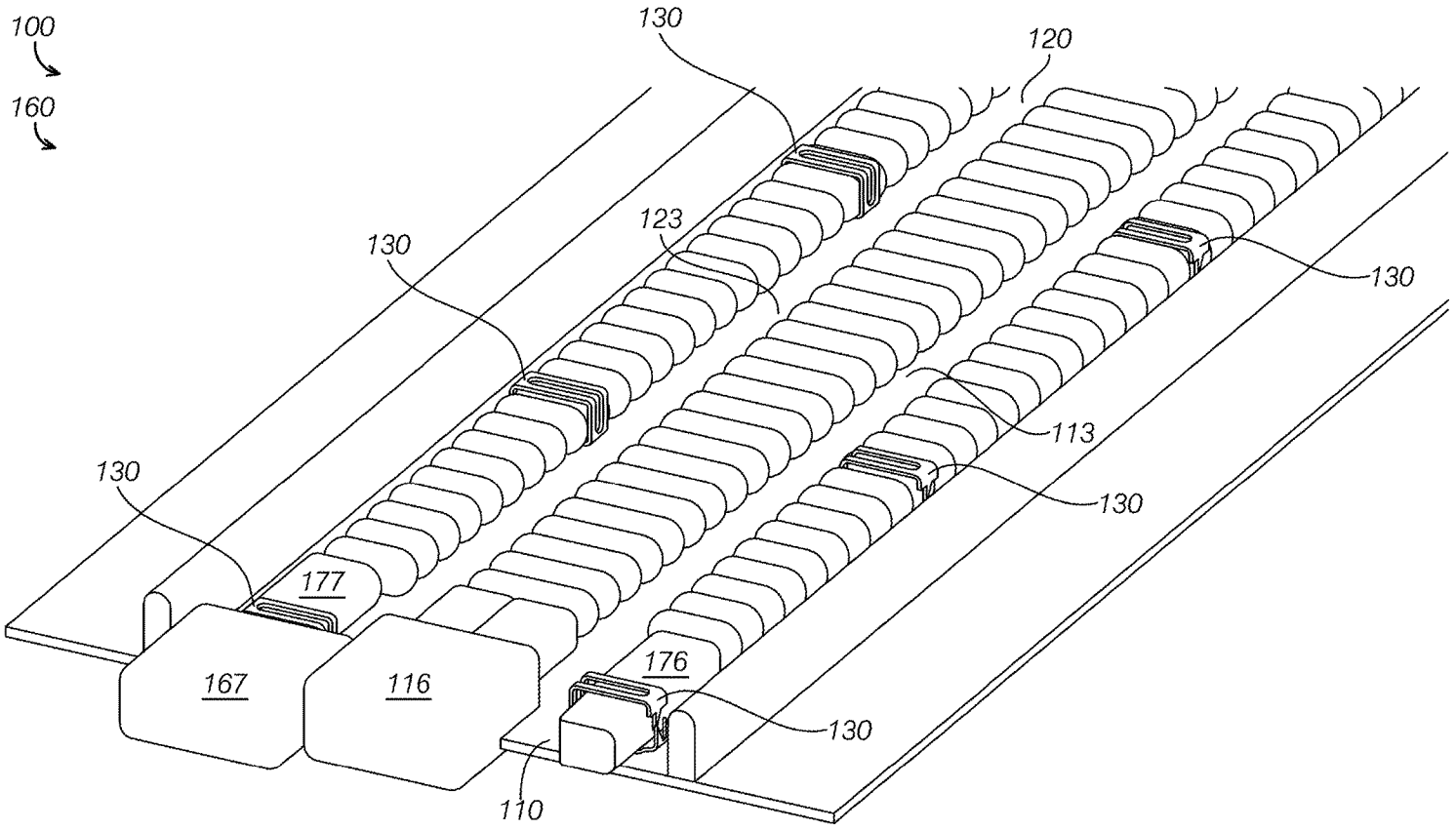
FIG. 10 is perspective view of a zipper repair system having attaching means in a closed position according to an embodiment of the invention

Referring finally to FIGS. 9 and 10, zipper 100 in the open and closed positions are shown and described. FIG. 9 is an illustration of zipper 100 in the open position and FIG. 10 is an illustration of zipper 100 in the closed position. As can be seen, a pair of attaching means 130 is positioned with one attaching means 130 enclosing first zipper right tape pin 176 and the other attaching means 130 enclosing a first zipper left tape pin 177 above first zipper retainer box 167. As can be seen each attaching means back 156 is positioned to face left tape proximal side 122 or right tape proximal side 113 with attaching means pin support 154 facing either left tape distal side 124 or right tape distal side 114 (also show in FIGS. 1 and 2). After the user has aligned zipper 100 and first zipper 160, she will she will attach zipper 100 to first zipper 160 by inserting a member of the plurality of first zipper left tape teeth 166 and first zipper right tape teeth 175 into a corresponding attaching means 130 where the attaching means is in the open position. In order to securely fasten zipper 100 to first zipper 160, the user will then apply downward pressure to each attaching means top 150 until it rests firmly over the first zipper tooth as shown in FIG. 10. In this manner, first zipper 160's only function becomes to act as a platform for zipper 100, while zipper 100 repairs the defective closure created by the malfunctioning first zipper 160.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A device for creating an enclosure, the device comprising a zipper having:

a plurality of attaching means;

a left strip comprising a plurality of left strip teeth, a left strip top stop, and a left strip bottom stop wherein the bottom stop houses a box; and a right strip having a plurality of right strip teeth, right strip top stop, and a right strip bottom stop having a right bottom stop pin wherein each of said plurality of attaching means further comprises:

an attaching means top having a top first plate, a top second plate, a top aperture, and a top pin;

an attaching means back having a back first plate, a back second plate, and a back aperture; and an attaching means base having a base proximal side, a base distal side, a base first plate, a base second plate, a base first tack having a first tack stationary end and a first tack securing end, a base second tack having a second tack stationary end and a second tack securing end, a base aperture having a first side and a second side, and wherein the base further comprises a base fork having a first tine and a second tine.

2. The device of claim 1 wherein the attaching means back is located within base distal side and continuous with base first plate and top first plate, and whereby back second plate is continuous with top second plate, and whereby the top pin is positioned over the base fork.

3. The device of claim 1 wherein each of the plurality of attaching means comprises an open position.

4. The device of claim 3 wherein the open position comprises the attaching means top at an acute angle with respect to the attaching means back and attaching means base and whereby the top pin does not touch the base fork.

5. The device of claim 3 wherein the closed position comprises a quadrilateral enclosure whereby the attaching means top positioned at a right angle with respect to the attaching means back, wherein the attaching means top is positioned parallel to the attaching means base and wherein the top pin is in contact with the base fork between the first tine and the second tine.

6. The device of claim 5 wherein of each of the said plurality of attaching means in the closed position forms an enclosure over the teeth of the standard zipper.

7. The device of claim 1 wherein the first aperture is located near the base proximal side and the second aperture is located near the base distal side.

8. The device of claim 7 wherein the first tack stationary end is substantially within the base distal side and adjacent to the base first plate, whereby the first tack stationary end is continuous with the base distal side and whereby the first tack securing end extends downward through first aperture; and whereby the second tack stationary end is continuous with the base proximal side and whereby the second tack securing end extends downward through second aperture.

9. The device of claim 8 wherein the first tack securing end and the second tack securing end of one of said plurality of attaching means are affixed to the left tape and wherein the first tack securing end of a second of said plurality of attaching means are affixed to the right tape.

10. A device for repairing a zipper, the zipper having a left tape having a plurality of left tape teeth, a left tape top stop, a left tape bottom stop, and a retaining box; a right tape having a plurality of right tape teeth, a right tape top stop, and a pin; and the device having:

a plurality of attaching means wherein the dimensions of each of the said plurality of attaching means are complimentary to the dimensions of the left tape teeth and the right tape teeth, and;

a left strip comprising a plurality of left strip teeth, a left strip top stop, and a left strip bottom stop wherein the bottom stop houses a box; and a right strip having a plurality of right strip teeth, right strip top stop, and a right strip bottom stop having a right bottom stop pin wherein each of said plurality of attaching means further comprises:

an attaching means top having a top first plate, a top second plate, a top aperture, and a top pin;

an attaching means back having a back first plate, a back second plate, and a back aperture; and an attaching means base having a base proximal side, a base distal side, a base first plate, a base second plate, a base first tack having a first tack stationary end and a first tack securing end, a base second tack having a second tack stationary end and a second tack securing end, a base aperture having a first side and a second side, and wherein the base further comprises a base fork having a first tine and a second tine.

11. The device of claim 10 wherein the attaching means back is located within base distal side and continuous with base first plate and top first plate, and whereby back second plate is continuous with top second plate, and whereby the top pin is positioned over the base fork.

12. The device of claim 10 wherein each of the plurality of attaching means comprises an open position and a closed position, wherein the open position comprises the attaching means top at an acute angle with respect to the attaching means back and to the attaching means base and whereby the top pin does not touch the base fork.

13. The device of claim 12 wherein the closed position comprises a quadrilateral enclosure whereby the attaching means top positioned at a right angle with respect to the attaching means back, wherein the attaching means top is positioned parallel to the attaching means base and wherein the top pin is in contact with the base fork between the first tine and the second tine.

14. The device of claim 10 wherein the first aperture is located near the base proximal side and the second aperture is located near the base distal side.

15. The device of claim 10 wherein the first tack stationary end is substantially within the base distal side and adjacent to the base first plate, whereby the first tack stationary end is continuous with the base distal side and whereby the first tack securing end extends downward through first aperture; and whereby the second tack stationary end is continuous with the base proximal side and whereby the second tack securing end extends downward through second aperture.

16. The device of claim 10 wherein the first tack securing end and the second tack securing end of one of said plurality of attaching means are affixed to the left tape and wherein the first tack securing end of a second of said plurality of attaching means are affixed to the right tape.

17. The device of claim 10 wherein the left tape is parallely aligned with the left strip and one of the plurality of left tape teeth is inserted into one of the plurality of attaching means in the open position and wherein the left tape is parallely aligned with the right strip and one of the plurality of right tape teeth is inserted into one of the plurality of attaching means in the open position.

18. The device of claim 17 wherein the left tape is secured to the left strip by placing each of the said plurality of attaching means in the closed position and the right tape is secured to the right strip by placing each of the said plurality of attaching means in the closed position.

* * * * *